US011849757B2

(12) United States Patent
Zouev

(10) Patent No.: US 11,849,757 B2
(45) Date of Patent: Dec. 26, 2023

(54) CHARCOAL-LESS HOOKAH AND COMPONENTS THEREOF

(71) Applicant: MVA Canada Inc, Concord (CA)

(72) Inventor: Alexander Zouev, Georgetown (CA)

(73) Assignee: 1293473 ONTARIO LIMITED

( * ) Notice: Subject to any disclaimer, the term of this patent is extended or adjusted under 35 U.S.C. 154(b) by 317 days.

(21) Appl. No.: 17/097,470

(22) Filed: Nov. 13, 2020

(65) Prior Publication Data

US 2022/0151290 A1 May 19, 2022

(51) Int. Cl.

| | |
|---|---|
| ***A24F 1/30*** | (2006.01) |
| ***A24F 40/90*** | (2020.01) |
| ***A24F 1/16*** | (2006.01) |
| ***A24F 1/14*** | (2006.01) |
| ***A24F 40/20*** | (2020.01) |
| ***A24F 40/46*** | (2020.01) |
| ***A24F 40/57*** | (2020.01) |

(52) U.S. Cl.

CPC ..... *A24F 1/30* (2013.01); *A24F 1/14* (2013.01); *A24F 1/16* (2013.01); *A24F 40/20* (2020.01); *A24F 40/57* (2020.01); *A24F 40/90* (2020.01)

(58) Field of Classification Search

CPC ..... A24F 1/30
USPC ..... 131/173, 230, 329, 331, 339
See application file for complete search history.

(56) References Cited

U.S. PATENT DOCUMENTS 10,383,363 B2 8/2019 Bavar

FOREIGN PATENT DOCUMENTS

FR WO 2020/025906 A1 * 2/2020 ..... A24F 1/30

OTHER PUBLICATIONS

WO2020/025906 A1 Mach English Translation; Alaoui, Sadek (Year: 2020).*

* cited by examiner

*Primary Examiner* — Michael J Felton
*Assistant Examiner* — Ronnie Kirby Jordan
(74) *Attorney, Agent, or Firm* — Merek, Blackmon & Voorhees, LLC

(57) ABSTRACT

A charcoal-less hookah and components thereof. Preferably, the charcoal-less hookah is an electronic hookah. A battery may be operably connected to one or more heating elements to heat the one or more heating elements to allow the hookah to be used at a site lacking an electrical outlet. Preferably, the battery is sufficiently removed from one or more heating elements and a heat exchanger so that the battery is not exposed to elevated or harmful temperatures. The charcoal-less hookah may include a hookah sub-assembly having a heating element, a heat exchanger and tobacco/smoked substance disposed below the heat exchanger and the heating element and an insulation section which is disposed above the tobacco/smoked substance and below a lower portion of the heating element and a lower portion of the heat exchanger. The insulation section is configured to prevent the smoked substance from being exposed to an evaporation temperature when the hookah is being operated but is not being used to smoke a smoked substance while exposing the smoked substance to a temperature equal to or exceeding the evaporation temperature when the hookah is operating and being used to smoke a smoked substance.

22 Claims, 18 Drawing Sheets

CHARCOAL-LESS HOOKAH AND COMPONENTS THEREOF

FIELD OF THE INVENTION

Preferred forms of the present invention are directed to a hookah and components thereof that allow one or more individuals to smoke a smokable material such that the vapor or smoke of the smokable material is filtered by or through a liquid (e.g., water) prior to the one or more individuals inhaling the smoke or vapor. One component of a preferred form of the present invention is a hookah sub-assembly including a heating element, a heat exchanger and an insulation section that is operably connected to a substance retaining section for retaining/holding tobacco or other substance to be smoked. The hookah sub-assembly is preferably configured so that it can be used in numerous different hookahs and is readily detachable from the substance retaining section. Further, the hookah sub-assembly is preferably configured to be used with a charcoal-less power source. For example, the hookah sub-assembly can be connected to a battery and/or an electrical outlet.

The hookah and components thereof are preferably directed to an electronic hookah where the power source electronically heats the substance to be smoked. A preferred form of the present invention is configured to insulate the tobacco or other substance to be smoked from one or more heating elements and the heat exchanger of the hookah so that the tobacco or other substance to be smoked is exposed to a temperature that is less than an evaporation temperature of the tobacco or other substance to be smoked when the hookah is operating but is not being used to smoke tobacco or other substance to be smoked and a temperature that exceeds the evaporation temperature of the tobacco or other substance to be smoked when the hookah is operating and is being used to smoke tobacco or other substance to be smoked.

In another preferred form, the present invention includes an electronic hookah having a battery for electronically heating one or more heating elements. The electronic hookah may include a power converter detachably or permanently connected to the battery. The power converter may be configured to receive a power cord having a free end formed as a standard plug that can be readily connected to an electrical outlet. The power converter may also be connected to one or more heating elements. The battery, when in an operating position, is spaced from the one or more heating elements and corresponding heat exchanger to avoid the battery from being exposed to elevated or harmful temperatures generated by the heating element or elements and components associated therewith (e.g. one or more heat exchangers) that can compromise the viability of the battery. The battery allows for operation of the electronic hookah assembly when the power converter is not connected to an electrical outlet or other power source (e.g., a generator). When the power converter is connected to an electrical outlet and the battery is connected to the power converter, the battery is charged while the power converter heats the one or more heating elements.

BACKGROUND OF THE INVENTION

A hookah is a known device that one or more individuals can use to smoke a smokable substance (e.g., tobacco). A hookah can be a single or multi-stemmed instrument for vaporizing and smoking tobacco (flavored or non-flavored) or other substance where the smoke or vapor is passed through a water basin or other liquid retaining structure before being inhaled by an individual.

OBJECTS AND SUMMARY OF THE INVENTION

An object of a preferred form of the present invention is to provide a novel and unobvious hookah and/or hookah sub-assembly.

Another object of a preferred form of the present invention is to provide an electronic hookah and/or components thereof that improve and/or enhance the smoking experience.

A further object of the present invention is to provide an insulating section, portion or segment that insulates a heating element and/or a heat exchanger from the substance to be smoked so that the substance to be smoked is not exposed to heated air at or in excess of an evaporation temperature of the substance to be smoked when the hookah is operating but is not being used to smoke tobacco or other substance to be smoked but the substance to be smoked is exposed to heated air at or above an evaporation temperature of the smoked substance when the hookah is operated by an individual to ingest smoke.

Still another object of the present invention is to provide a hookah in which the substance to be smoked reaches an evaporation temperature only when an individual is using the hookah to smoke tobacco or other substance to be smoked.

A further object of the present invention is to provide an electronic hookah that can be operated by only a battery so that the hookah can be readily moved between various operating locations including an operating location in which as electrical outlet or other power source (e.g., generator) is not present.

Yet a further object of the present invention is to provide a battery powered electronic hookah where the battery is not exposed to temperatures that would adversely affect the battery.

Still a further object of the present invention is to provide a charcoal-less hookah.

Still another object of the present invention is to provide a portable electronic hookah. It must be understood that no one embodiment of the present invention need include all of the aforementioned objects of the present invention. Rather, a given embodiment may include one or none of the aforementioned objects of the preferred forms of the invention. Accordingly, these objects are not to be used to limit the scope of the claims of the present invention. Further, the above is not an exhaustive list of the advantages and objects of the preferred forms of the present invention. Other advantages and objects of preferred forms of the present invention will be readily appreciated from the description of the preferred forms of the present invention.

In summary, one preferred embodiment of the present invention is directed to a method including the steps of providing a hookah sub-assembly including a heating element, a heat exchanger and tobacco or other substance to be smoked disposed below the heat exchanger and the heating element, wherein the tobacco or other substance to be smoked evaporates at a first temperature. Heating the heating element to a second temperature which is higher than the first temperature. Insulating the tobacco or other substance to be smoked from the heating element and the heat exchanger of the hookah sub-assembly so that a temperature the tobacco or other substance to be smoked is exposed to is less than the first temperature when the hookah sub-assembly is operating but is not being used to smoke tobacco or other substance to be smoked and a temperature the tobacco or other substance to be smoked is exposed to is greater than or equal to the first temperature when the hookah sub-assembly is operating and is being used to smoke tobacco or other substance to be smoked.

In summary, another preferred embodiment of the present invention is directed a hookah sub-assembly including a charcoal-less heating element, a heat exchanger and tobacco or other substance to be smoked disposed below the heat exchanger and the charcoal-less heating element, wherein the tobacco or other substance to be smoked evaporates at a first temperature. The charcoal-less heating element being configured to heat ambient temperature air to a second temperature which is higher than the first temperature. An insulating section insulates the tobacco or other substance to be smoked so that a temperature the tobacco or other substance to be smoked is exposed to is less than the first temperature when the hookah sub-assembly is operating but not being used to smoke tobacco or other substance to be smoked and a temperature the tobacco or other substance to be smoked is exposed to is greater than or equal to the first temperature when the hookah sub-assembly is being used to smoke tobacco or other substance to be smoked.

In summary, a further preferred embodiment of the present invention is directed to a hookah including an electronic heating element, a heat exchanger, a tobacco housing for housing tobacco or other substance to be smoked, an inhalation port and a liquid housing for housing a filtering liquid. The tobacco housing is disposed below the heat exchanger and the electronic heating element, wherein the tobacco or other substance to be smoked evaporates at a first temperature. The electronic heating element is configured to heat ambient temperature air to a second temperature which is higher than the first temperature. At least a portion of the electronic heating element is disposed above at least a portion of the heat exchanger. An insulating member is disposed below the heat exchanger and configured to insulate the tobacco or other substance to be smoked so that the temperature the tobacco or other substance to be smoked is exposed to is less than the first temperature when the hookah is operating but is not being used to smoke tobacco or other substance to be smoked and a temperature the tobacco or other substance to be smoked is exposed to is greater than the first temperature when the hookah is operating and being used to smoke tobacco or other substance to be smoked.

In summary, still another preferred embodiment of the present invention is directed to an electronic hookah including an electronic heating element, a heat exchanger, a tobacco bowl for housing tobacco or other substance to be smoked, an inhalation port and a liquid housing for housing a filtering liquid. A battery is operably connected to a power converter and the heating element. The power converter is operably connected to the battery and the electronic heating element to heat the electronic heating element wherein the battery is spaced from the heating element to avoid the battery from being exposed to elevated temperatures generated by the heating element that would compromise the viability of the battery.

The preferred forms of the present invention described above provide various examples of preferred embodiments of the present invention and are not to be construed as limiting the present invention to any of the preferred forms described above in this section or any preceding or subsequent section.

DETAILED DESCRIPTION OF THE PREFERRED EMBODIMENTS OF THE INVENTION

Figure 1:
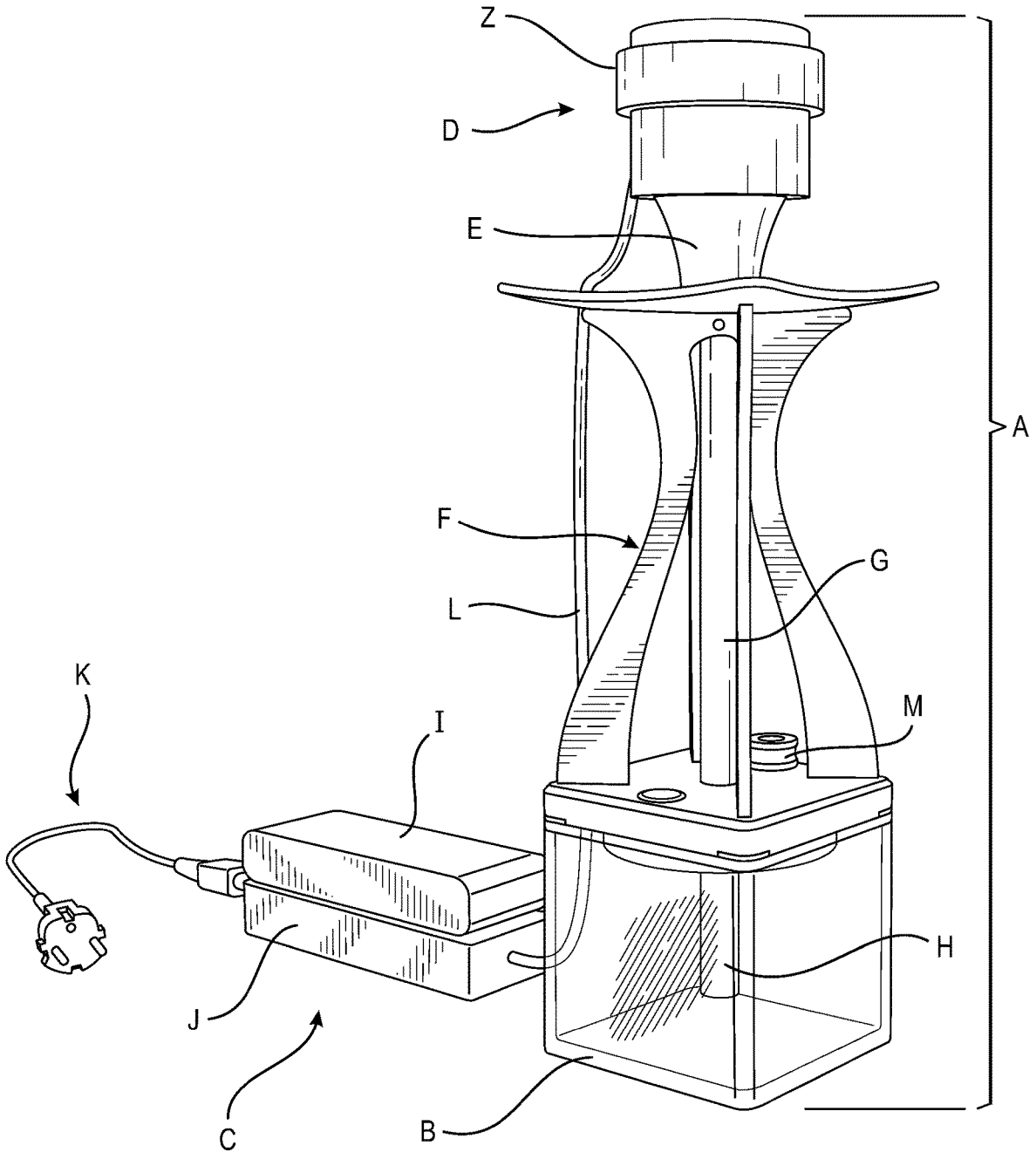
FIG. 1 is a perspective view of a hookah formed in accordance with a preferred embodiment of the present invention with the smoking or inhalation hose/conduit/tube removed (i.e., not shown).

The preferred forms of the invention will now be described with reference to FIGS. 1-17. The appended claims are not limited to the preferred forms and no term and/or phrase used herein is to be given a meaning other than its ordinary meaning unless it is expressly stated otherwise.

The preferred forms of the present invention are directed to a charcoal-less hookah, i.e., the tobacco or other substance to be smoked is heated to a state where the substance can be smoked with a heating component, assembly or source other than charcoal. Preferably, the heating component, assembly or source includes one or more heating elements operably connected to an electrical power source (e.g., a battery or electrical outlet).

For example, the heating element or elements could be one or more cylindrical or circular plates operably connected to a heat exchanger. The one or more heating elements could be disposed relative to the heat exchanger in many different manners. For example, the one or more heating elements could be mounted on top of an upper portion of the heat exchanger. The one or more heating elements could be disposed between a first portion and a second portion of the heat exchanger.

The first portion of the heat exchanger could be formed from one or more pieces. The second portion of the heat exchanger can also be formed from one or more pieces. Preferably, the first portion and the second portion of the heat exchanger are identical or substantially identical in configuration so that the first portion can form an upper portion of a heat exchanger when oriented in a first manner and the first portion can form a lower portion of a heat exchanger when oriented in a second manner and the second portion can form an upper portion of a heat exchanger when oriented in a first manner and the second portion can form a lower portion of a heat exchanger when oriented in a second manner. The interchangeability of these parts facilitates assembly of the heat exchanger.

The charcoal-less hookah preferably includes a battery power option, i.e., the one or more heating elements of the hookah can be heated solely by one or more batteries forming a battery pack. This feature allows the hookah to be operated at numerous different sites where no electrical outlet or other power source (e.g., generator) is available. For example, the hookah could be operated on the beach or in a remote wooded area. Preferably, the hookah is configured such that the battery back when operably connected to one or more heating elements and a corresponding heat exchanger, the battery back is positioned remote from both the one or more heating elements and the corresponding heat exchanger to prevent the battery pack from being exposed to elevated or harmful temperatures that could damage or compromise the battery pack including one or more batteries.

In a preferred embodiment, the battery pack is operably connected to a power converter where the power converter is connected at one end to an electrical outlet or other power source (e.g., generator) and at the other end to one or more heating elements. This option allows the hookah to be powered while simultaneously charging the battery pack. The battery pack can be permanently or detachably connected to the power converter. This option includes a power cord that connects the power converter to an electrical outlet or other power source (e.g., generator) and an electrical cord that the that connects the power converter to one or more heating elements. The power cord and the electrical cord can both be detachably connected to the power converter.

A preferred form of the present invention includes a hookah sub-assembly that insulates the tobacco or other substance to be smoked from the one or more heating elements and the corresponding heat exchanger so that when the hookah is operating to heat the one or more heating elements but is not be used to inhale a substance to be smoked, the substance to be smoked is not exposed to a temperature that will evaporate the substance to be smoked and when the hookah is operating and being used by an individual to smoke or inhale the substance to be smoked, the substance to be smoked is exposed to a temperature that is equal to or exceeds the temperature that will evaporate the substance to be smoked. The substance to be smoked evaporates at a first temperature or temperature range. For example, the first temperature range could be 184 to 186 degrees Celsius. The one or more heating elements are preferably heated to a temperature considerably higher than the first temperature range. Preferably, the one or more heating elements are heated to a temperature at least 50 degrees Celsius greater than the first temperature or temperature range. Most preferably, the one or more heating elements are heated to 280 Celsius and the one or more heating elements and corresponding heat exchanger heat the air to at or about 280 Celsius during an inhalation stage of operation of the hookah.

The hookah sub-assembly preferably includes a thermal insulator that acts to insulate the substance to be smoked from the heating element and the heat exchanger so that while the charcoal-less hookah is on or operating but not being used to inhale or smoke a substance to be smoked, the substance to be smoked is exposed to a temperature less than the evaporation temperature of the substance to be smoke and when the hookah is operating and being used to smoke a substance, the substance to be smoked is exposed to a temperature that equals or exceeds the evaporation temperature of the substance to be smoked. More particularly, the one or more heating elements heat a heat exchanger and during an inhalation stage (i.e., a stage an individual is inhaling or smoking a substance to be smoked, ambient temperature is passed through the heat exchanger where the ambient air is heated by surface contact with fins or other portions of the heat exchanger. The heated air travels through the insulator and the substance to be smoked to cause the substance to be smoked to evaporate. The heated air passing through the substance to be smoked during an inhalation stage is at a temperature that equals or exceeds the evaporation temperature. The temperature of the heated air passing through the substance to be smoked during an inhalation stage can be equal to or slightly less than the temperature the one or more heating elements are heated to by the power source. The evaporated substance to be smoked passes into a liquid filter housing that houses a filtering liquid, e.g. water. The liquid filter housing preferably includes an inhalation port that an inhalation tube, conduit, hose or other suitable structure is attached and used by an individual to inhale or smoke the substance to be smoked after this substance has passed through the filtering liquid.

Preferably, the hookah sub-assembly forms an upper or uppermost portion of the hookah and includes a gripping portion (e.g., an outer annular collar) that an individual can grip even when the one or more heating elements are heated to a maximum temperature so that an individual can safely move the hookah, the hookah sub-assembly or a portion of the hookah sub-assembly even when the one or more heating elements are at a maximum or elevated temperature.

Reference will be made to FIGS. 1 to 17, to describe the preferred forms of the present invention. FIGS. 1 to 8 depict a first preferred embodiment including a hookah A having a liquid retaining tank B (e.g., a water retaining tank) storing or housing a filtering liquid, a power assembly C, a hookah sub-assembly D, a bowl or housing E that retains or houses a substance to be smoked, a support platform F that supports the hookah sub-assembly above tank B, conduit or pipe G that connects the sub-assembly D and housing E to tank B to direct the substance to be smoked downwardly into the filtering liquid housed in tank B to filter the substance to be smoked. The lower portion H of pipe or conduit G can be formed as any known diffuser to adequately disperse the substance to be smoked in water or other filtering fluid housed in tank B. The power assembly includes a battery pack I, a power converter J, a power cord K and an electrical connection, wire or cord L connecting power converter J to one or more heating elements of sub-assembly D. Tank B includes an inhalation port M that is configured to receive an inhalation tube, conduit, hose or other suitable structure or segment that an individual can use to inhale or smoke a substance to be smoked. For example, the inhalation tube, conduit, hose or other suitable structure or segment can be detachably connected to port M.

Figure 2:
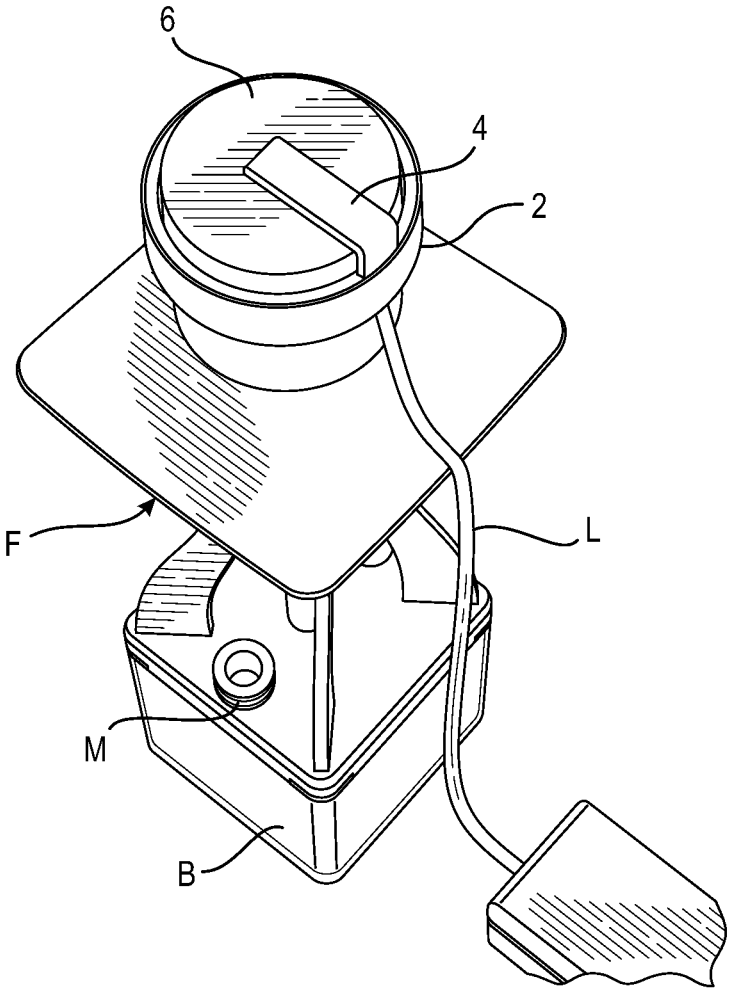
FIG. 2 is a perspective view of the hookah of FIG. 1 taken from a different vantage point.
Figure 3:
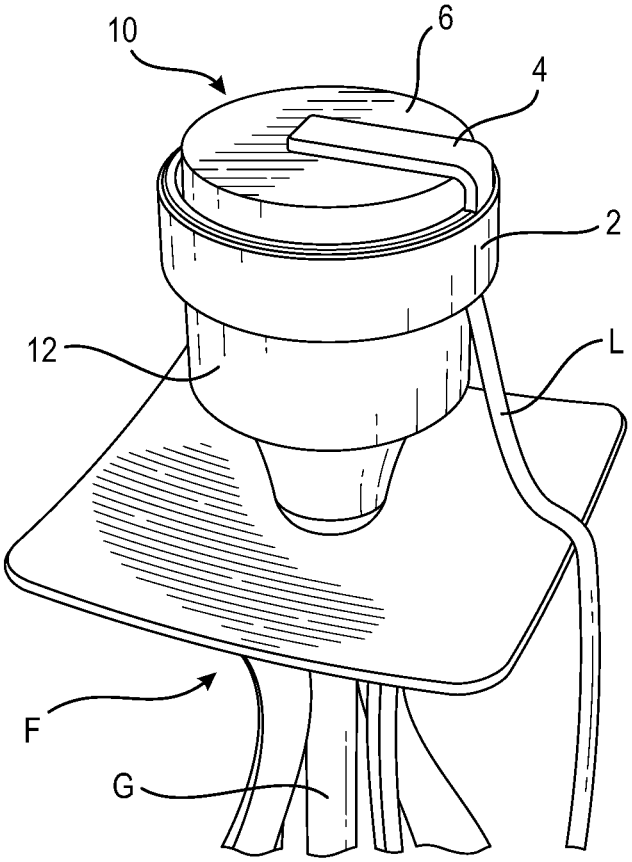
FIG. 3 is an enlarged perspective of an upper portion of the hookah of FIG. 1.

Referring to FIGS. 1 to 3, hookah sub-assembly D includes a protective collar 2 surrounding an upper portion of hookah sub-assembly D. Protective collar 2 includes attachment portion 4 that is fixed connected to upper surface 6 of hookah sub-assembly D and gripping collar or portion 2 that an individual can safely grip even when the hookah sub-assembly D is heated to a maximum or elevated temperature. Portion 2 and portion 4 may be formed from a single piece of material. Portion or collar 2 and portion 4 can be formed from any suitable material that is resistant to temperature changes, e.g., when an inner surface of the portion 2 is exposed to an elevated temperature, the elevated temperature is not transmitted to an outer gripping surface of portion 2.

Hookah sub-assembly D, as seen in for example FIGS. 3 to 8, included an outer cover or shell 10 having an upper horizontally extending surface 6 and a vertically extending annular wall portion 12. Preferably, outer wall portion 12 has a constant or substantially constant diameter and houses an upper portion of a housing 13 for housing and retaining a substance to be smoked. However, the cover or shell 10 can take any suitable form. As seen in, for example FIG. 4, a vertically extending inner surface of gripping portion 6 is spaced from an outermost surface of wall portion 12 to reduce the exposure of gripping portion 6 to elevated temperatures.

Outer cover or shell 10 preferably houses one or more heating elements and a heat exchanger. In a preferred embodiment, a pair of heating plates (e.g., circular or cylindrical plates) 14 and 16 are disposed between an upper portion 18 and lower portion 20 of a heat exchanger. Preferably, the outermost surface of plates 14 and 16, portions 18 and 20 and housing 13 are all spaced inwardly from the innermost surface of wall portion 12 to create an air passageway allowing ambient temperature air to pass upwardly and into one or more openings formed in upper portion 18 of the heat exchanger. One or both of plates 14 and 16 are connected to electrical cord L. One or more bolts 22 or other suitable fastener may connect plates 14 and 16 and portions 18 and 20 together so that these elements can be installed and/or removed as a single unit.

An insulator 24 separates plates 14 and 16 and portions 18 and 20 of the heat exchanger from the substance to be smoked stored in housing 13 to insulate the substance to be smoked from air at or above an evaporation temperature when the hookah is operating but is not being used by an individual to inhale or smoke a substance to be smoked. Preferably, insulator 24 is a member that connects to a bottom or lower portion 20 of the heat exchanger to form an insulating air chamber. In a most preferred form, insulator 24 is a cylindrical member having an open top, a bottom wall 26 and a vertically extending annular wall 28 extending upwardly from the bottom wall 26.

Figure 6:
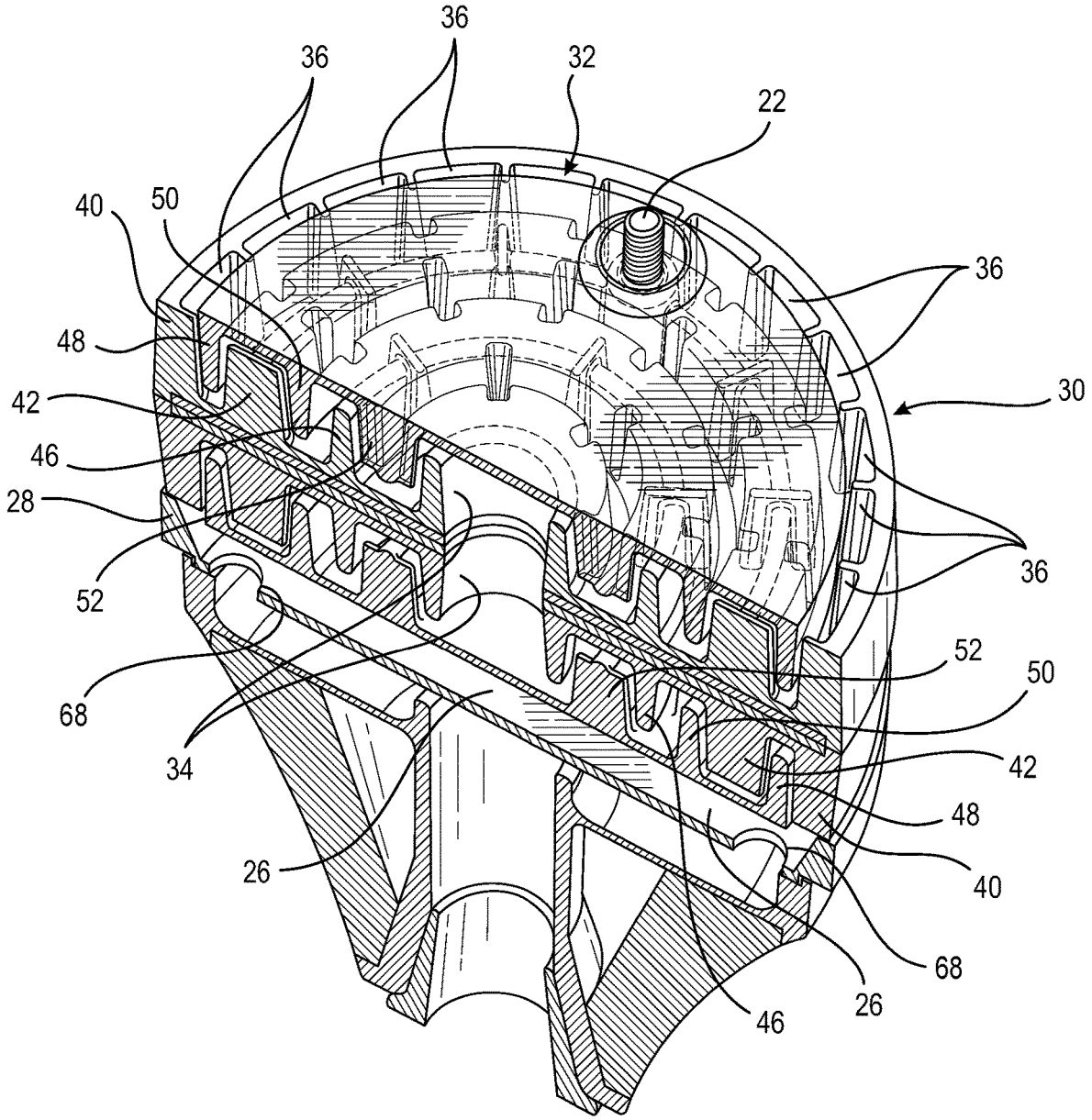
FIG. 6 is a cross-sectional perspective view of a portion of the hookah sub-assembly of FIG. 4.
Figure 7:
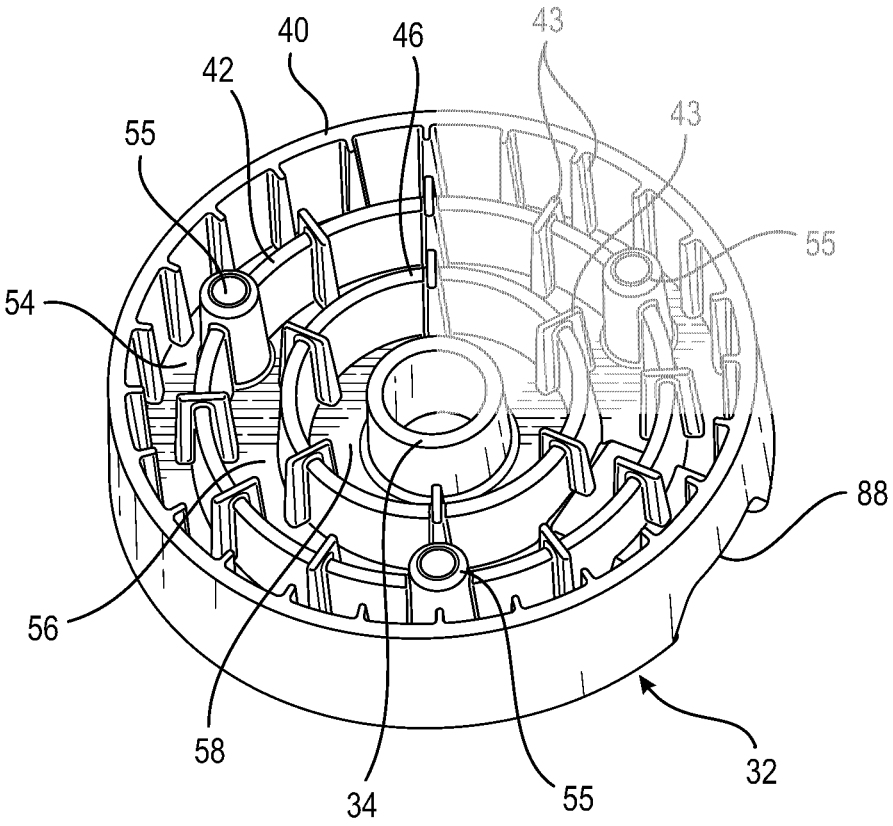
FIG. 7 is a perspective view of a portion of a preferred heat exchanger.
Figure 8:
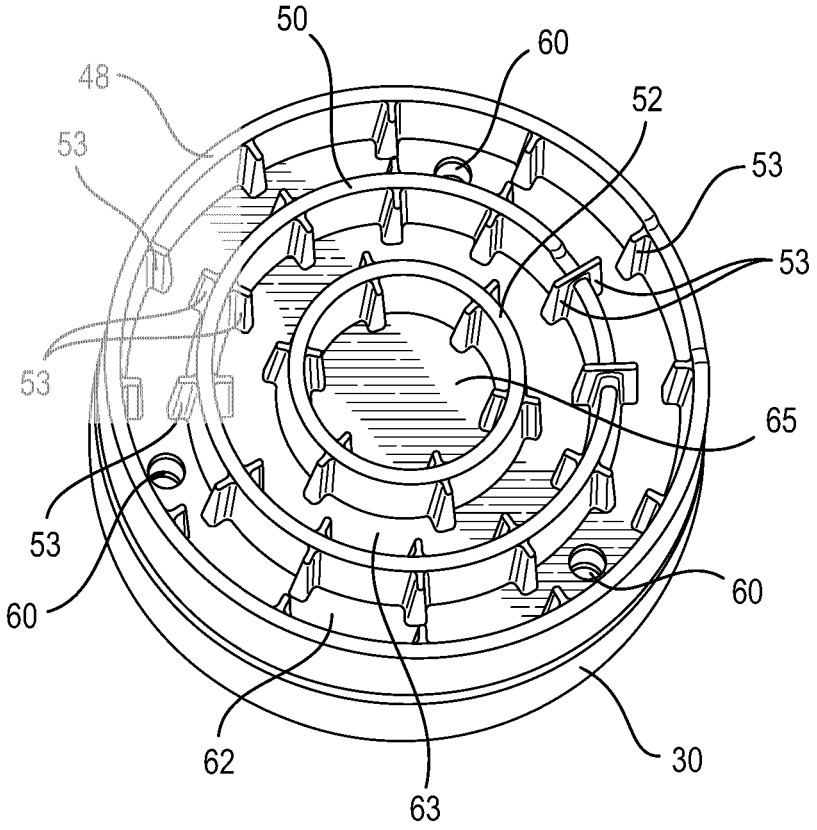
FIG. 8 is a perspective view of another portion of a preferred heat exchanger.

Upper portion 18 preferably, includes member 30 and member 32. FIG. 7 depicts a preferred form of member 30 and FIG. 8 depicts a preferred form of member 32. As seen in, for example FIG. 6, member 30 mates with or nests in member 32 creating an undulating air passageway having a plurality of peaks and valleys for air to travel through upper portion 18 and exit upper portion 18 through outlet 34 of member 32. As seen in FIG. 6, the mating or nesting of member 30 and member 32 creates a plurality of inlet openings or areas 36 through which air can enter the upper portion 18 adjacent an outer edge of upper portion 18. As seen in, for example FIG. 6, plates 14 and 16 have central openings that have the same size or substantially the same size as the inner diameter of outlet 34.

Referring to FIG. 7, member 32 includes a plurality of annular wall segments 40, 42 and 46. Each annular wall segment may be provided with one or more heat transfer fins 43. Referring to FIG. 8, member 30 includes a plurality of annular wall segments 48, 50 and 52. Each annular wall segment may be provided with one or more heat transfer fins 53. Annular wall segment 48 of member 30 extends downwardly between the space formed between annular wall segments 40 and 42 of member 32. The lowermost portion of annular wall segment 48 is spaced above the bottom surface 54 extending between annular wall segments 40 and 42 of member 32. Similarly, uppermost portion of annular wall segment 42 is spaced from surface 62 extending between annular wall segments 48 and 50. This causes air entering upper portion 18 through inlets 36 to initially flow downwardly, then around the lowermost portion of annular wall segment 48 and upwardly and around an uppermost portion of annular wall segment 42.

Annular wall segment 50 of member 30 extends downwardly between the space formed between annular wall segments 42 and 46 of member 32. The lowermost portion of annular wall segment 50 is spaced above the bottom surface 56 extending between annular wall segments 42 and 46 of member 32. Similarly, uppermost portion of annular wall segment 46 is spaced from surface 63 extending between annular wall segments 50 and 52. This causes air traveling around uppermost portion of segment 42 to flow downwardly, then around the lowermost portion of annular wall segment 50 and upwardly and around an uppermost portion of annular wall segment 46.

Annular wall segment 52 of member 30 extends downwardly between the space formed between annular wall segment 46 and outlet 34 of member 32. The lowermost portion of annular wall segment 52 is spaced above the bottom surface 58 extending between annular wall segment 46 and outlet 34 of member 32. Similarly, surface 65 of member 30 is spaced from an uppermost portion of outlet 34 of member 32. This causes air traveling around uppermost portion of segment 46 to flow downwardly, then around the lowermost portion of annular wall segment 52 and upwardly and around an uppermost portion of outlet 34 and then out upper portion 18 through outlet 34.

Lower section 20 of the heat exchanger is formed by nesting or mating member 32 depicted in FIG. 7 in or with member 30 depicted in FIG. 8. In the lower portion 20 of the heat exchanger, member 32 forms the upper or top section of portion 20 and member 30 forms the lower or bottom section. In other words, upper portion 18 can be merely flipped over to be used as the lower portion 20 of the heat exchanger. Air initially enters lower portion 20 through member 34 which forms an inlet for lower portion 20. Air travels in an undulating air path having a plurality of peaks and valleys in a similar manner to that described in connection with the upper portion 18 with the exception that air flows from the center outwardly whereas the flow or air through upper portion 18 is the opposite, i.e., air travels from an outer area of portion 18 to the center of portion 18. Air exits lower portion through openings or open areas 36 as seen in, for example 5, and enters the open top of insulator 24.

A plurality of openings 60 are formed in surface 62 of member 30 to receive a corresponding bolt 22. A plurality of openings 55 are formed in annular wall segment 42 of member 32 to receive a corresponding bolt 22. Openings are also formed in plates 14 and 16 to receive a corresponding bolt 22 as seen in, for example FIG. 4. While the preferred embodiment is configured to receive three bolts, the number and type of fasteners can be readily varied as desired.

One or more openings 68 formed in bottom surface 26 of insulator 24 allow air to exit insulator 24 and enter housing 13 which preferably has an open upper end. Preferably, member 30 of lower portion 20 is detachably mounted on housing 13 so that an individual can readily refill housing 13 with a substance to be smoked by detaching outer shell 10, the assembly including the one or more heating elements and the heat exchanger and insulator 24 from housing 13. Outer shell 10, the assembly including the one or more heating elements and the heat exchanger and insulator 24 may be connected in any known manner so that by merely raising outer shell 10, outer shell 10, the assembly including the one or more heating elements and the heat exchanger and insulator 24 may be removed from housing 13 as a single unit.

Figure 4:
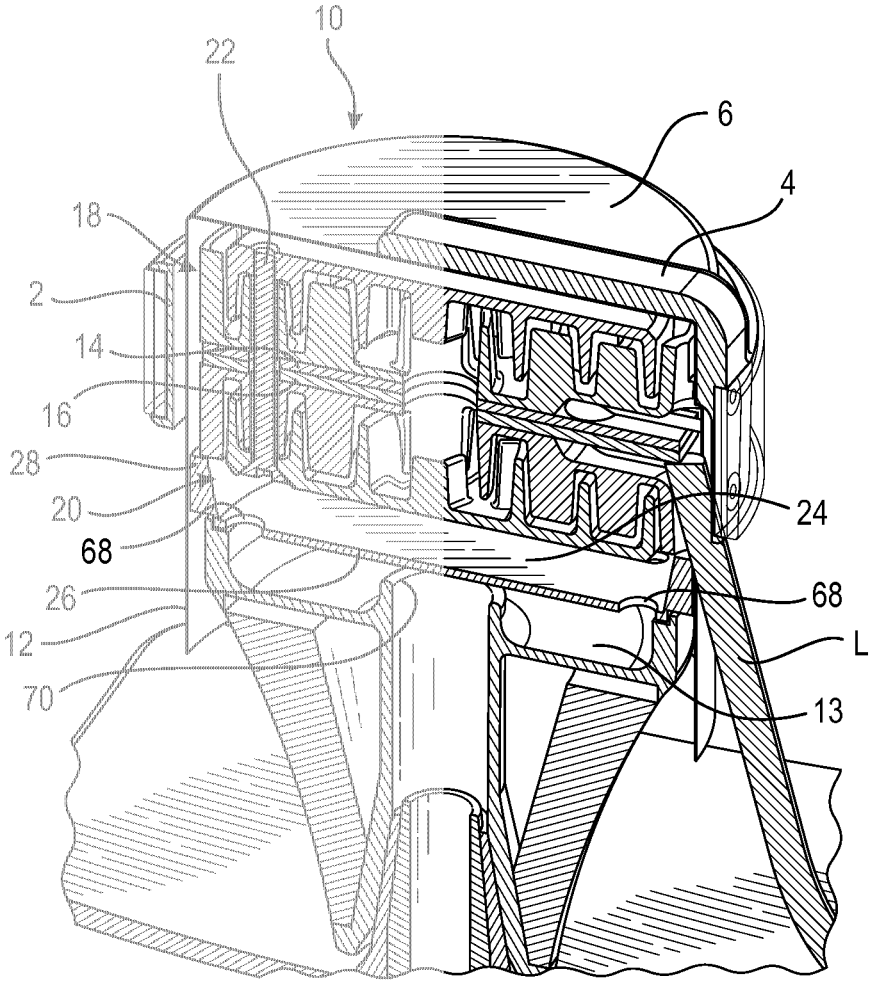
FIG. 4 is a cross-sectional perspective view of a preferred hookah sub-assembly of the hookah of FIG. 1.
Figure 5:
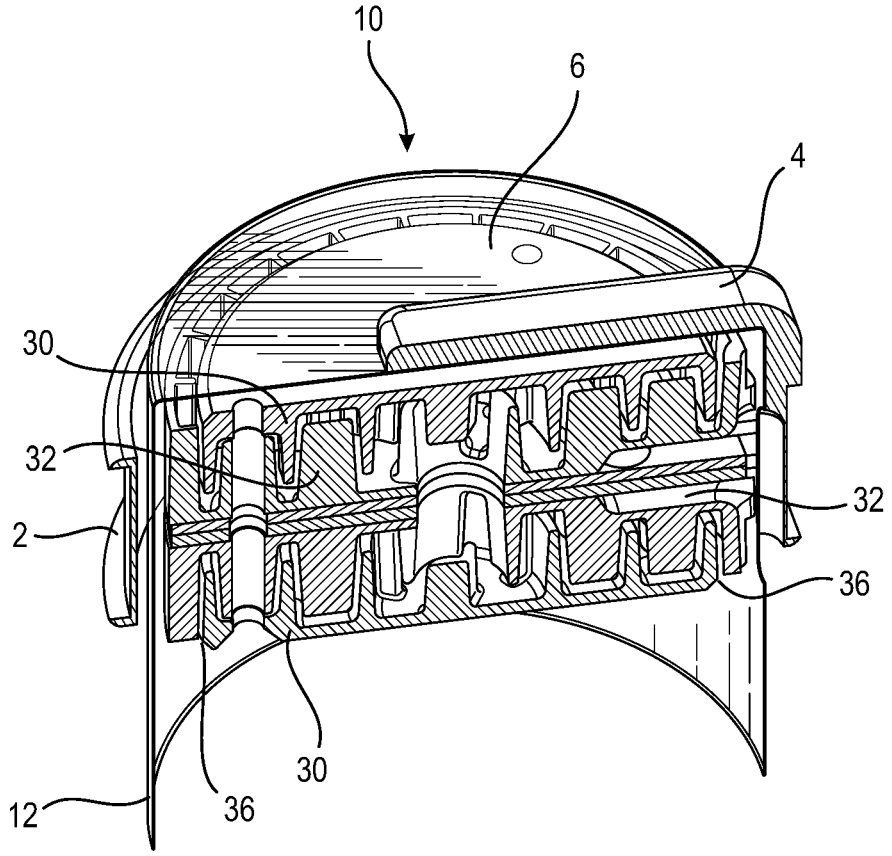
FIG. 5 is a cross-sectional perspective view of a portion of the hookah sub-assembly of FIG. 4.

Referring to FIG. 4, member G has an open upper end 70 disposed in housing 13 to allow smoke to enter member G and travel downwardly into tank B. During an inhalation stage, air enters hookah sub-assembly D through the annular spaced formed between the inner surface of member 12 and the outermost surfaces of members or portions 14, 16, 18 and 20. Air enters and exits the upper and lower portions 18 and 20 as described above, passes through insulator 24 and enters housing 13 to heat the substance to be smoked. The temperature of air entering housing 13 during an inhalation stage is at or above the evaporation temperature of the substance to be smoked. In a most preferred form, air enters housing 13 during an inhalation stage at or about the same temperature that the heating element is heated to, for example, 280 Celsius or thereabouts.

Figure 1A:
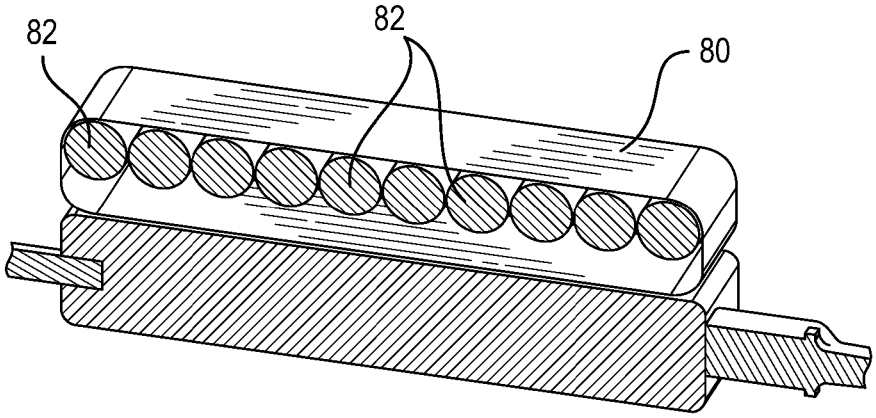
FIG. 1A is a cross-sectional perspective view of a preferred battery detachably mounted on top of a preferred power converter.
Figure 1B:
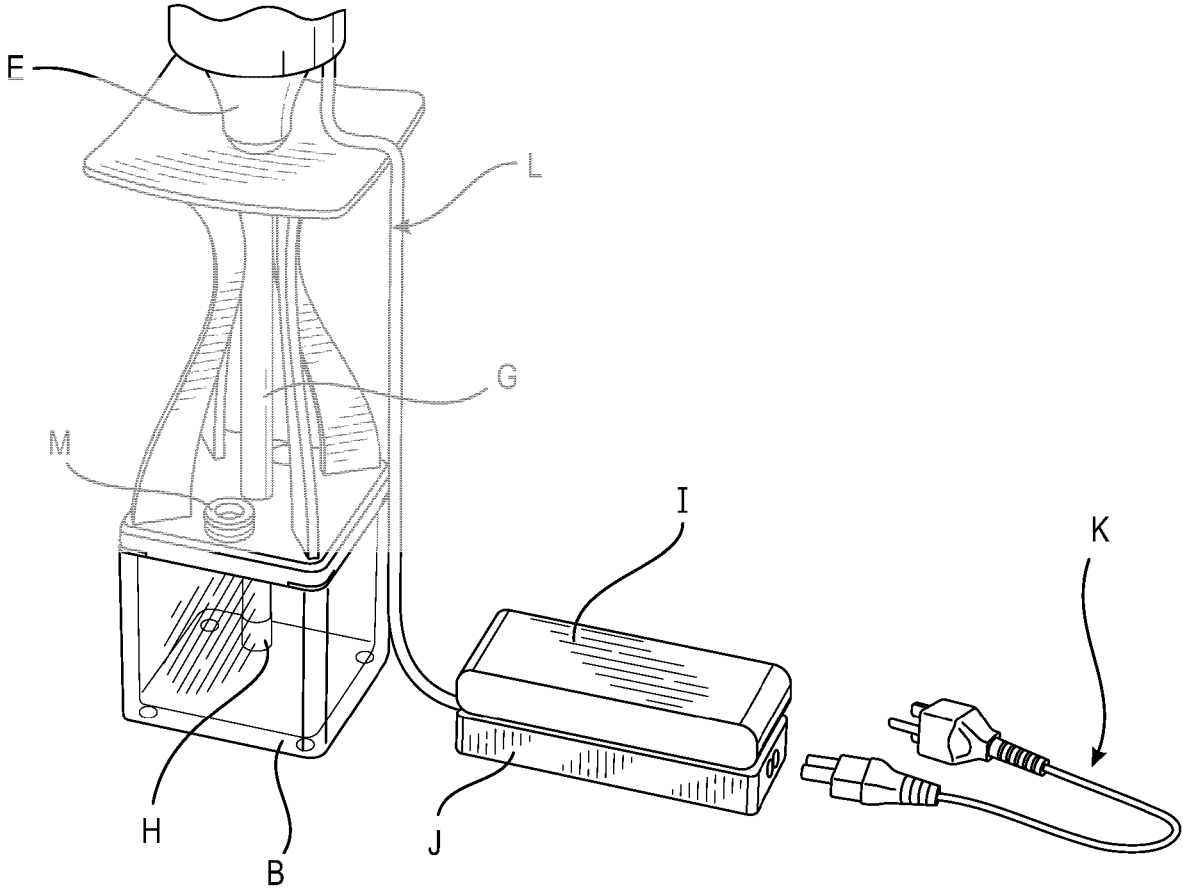
FIG. 1B is perspective view of a portion of the hookah depicted in FIG. 1.

Referring to FIGS. 1A and 1B, the power assembly will be further described. Battery pack I may include a casing or housing 80 storing one or more batteries 82. Preferably, battery pack I is mounted on top of power converter J. This mounting may be configured to allow battery pack I to be readily detached, separated or removed from power converter J. Power cord K preferably includes a standard plug at one end that can be readily connected to an electrical outlet. The other end of power cord K is preferably formed to be detachably connected to power converter J. An electrical cord, conduit or wire L is detachably connected to power converter J at one end and connected to heating elements 14 and 16 at the other end. Referring to FIG. 7, member 30 of the upper and lower portions 18 and 20 can have a notch or recess 88 formed in an outer wall to allow the corresponding end of member L to be connected to heating element 14 and/or 16. Referring to FIGS. 1 and 1B, battery pack I is positioned remote from the one or more heating elements and the heat exchanger to prevent the battery pack I from being exposed to elevated temperatures which could damage or compromise the battery pack I. When the power assembly is connected to an electrical outlet and the hookah sub-assembly, the heating elements are heated to the desired temperature while the battery pack I is also charging. The battery pack I allows the hookah to be operated at numerous different sites lacking an electrical outlet or other power source that the plug of the power cord can be connected to.

Figure 9:
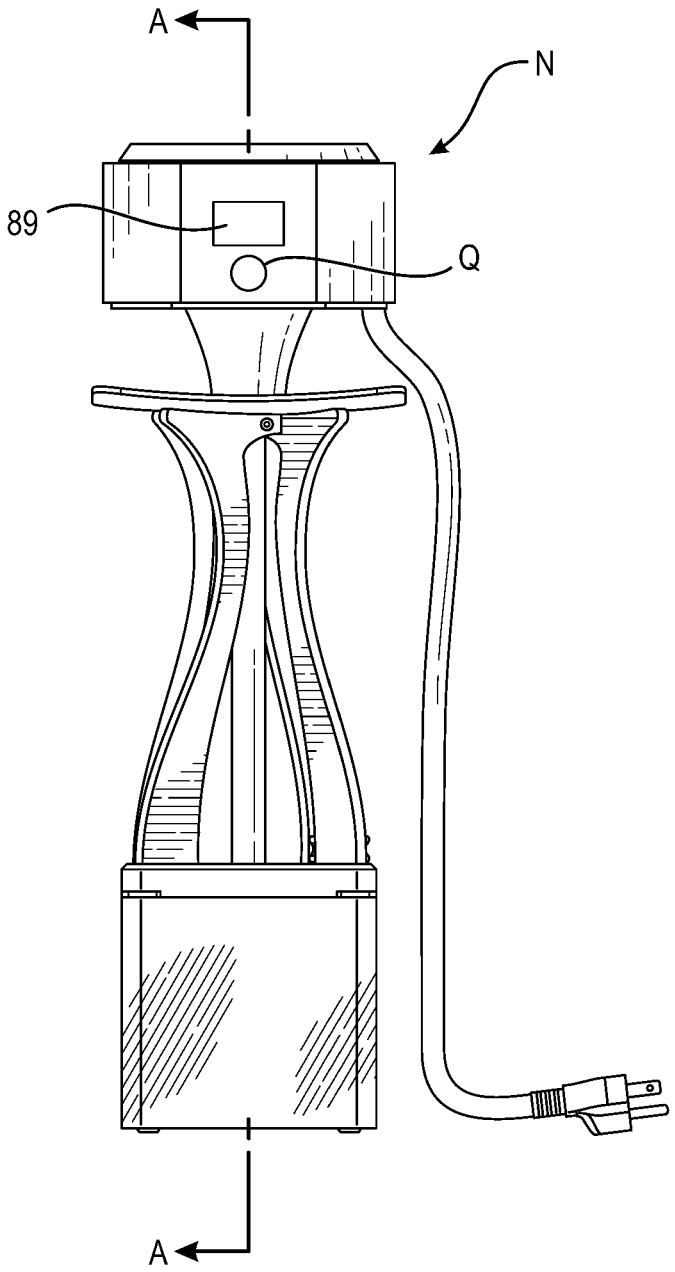
FIG. 9 is an elevational view of another preferred hookah.
Figure 10:
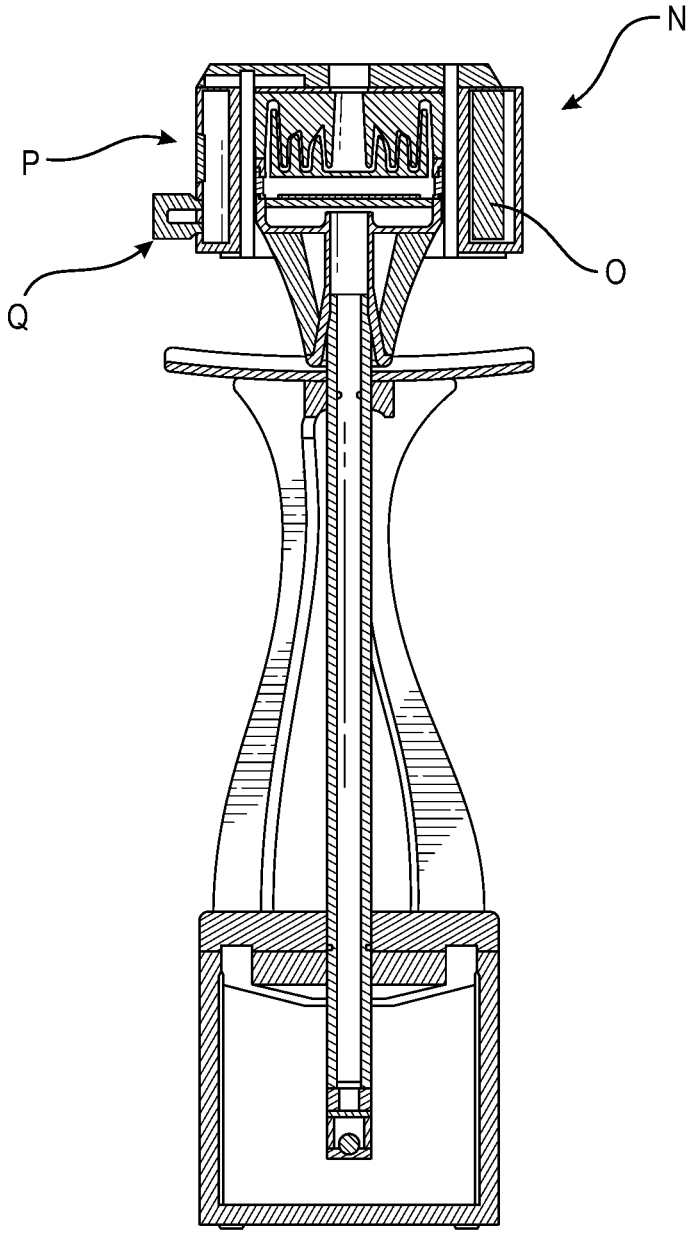
FIG. 10 is a cross-sectional view of taken along lines A-A in FIG. 9.

FIGS. 9 and 10 depict one alternative form of the charcoal-less hookah. Hookah N of this embodiment is an electric hookah where the battery and/or power converter O are housed in the hookah sub-assembly P. Temperature control Q can readily control the temperature of the one or more heating elements. A digital display 89 can be provided to inform the user of the temperature of the heating elements and the heat exchanger. In this embodiment the battery and/or power converter O are protected by an insulation casing.

Figure 11:
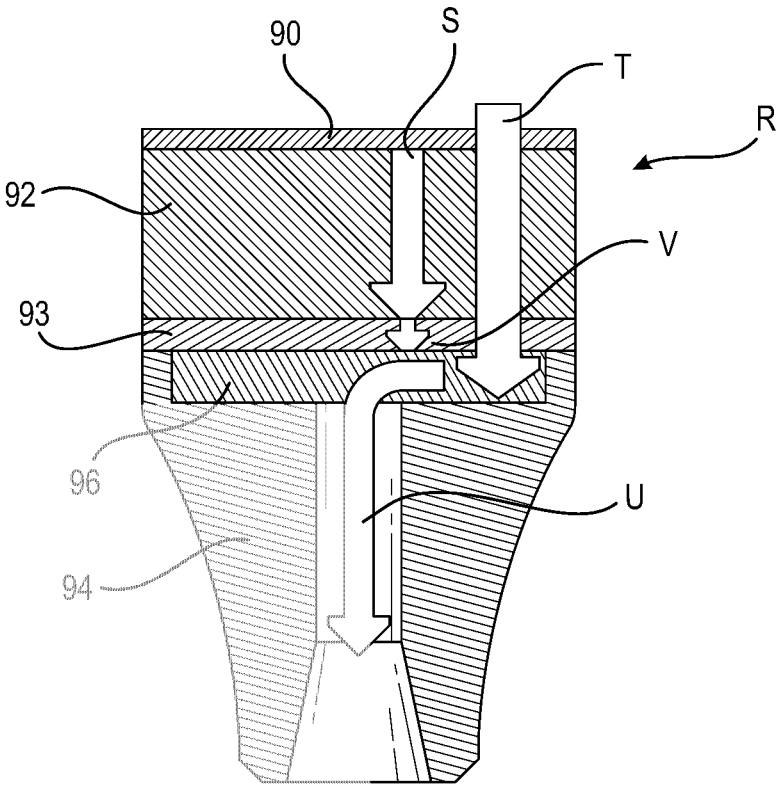
FIG. 11 is a schematic cross-sectional view of another preferred form of hookah sub-assembly.
Figure 12:
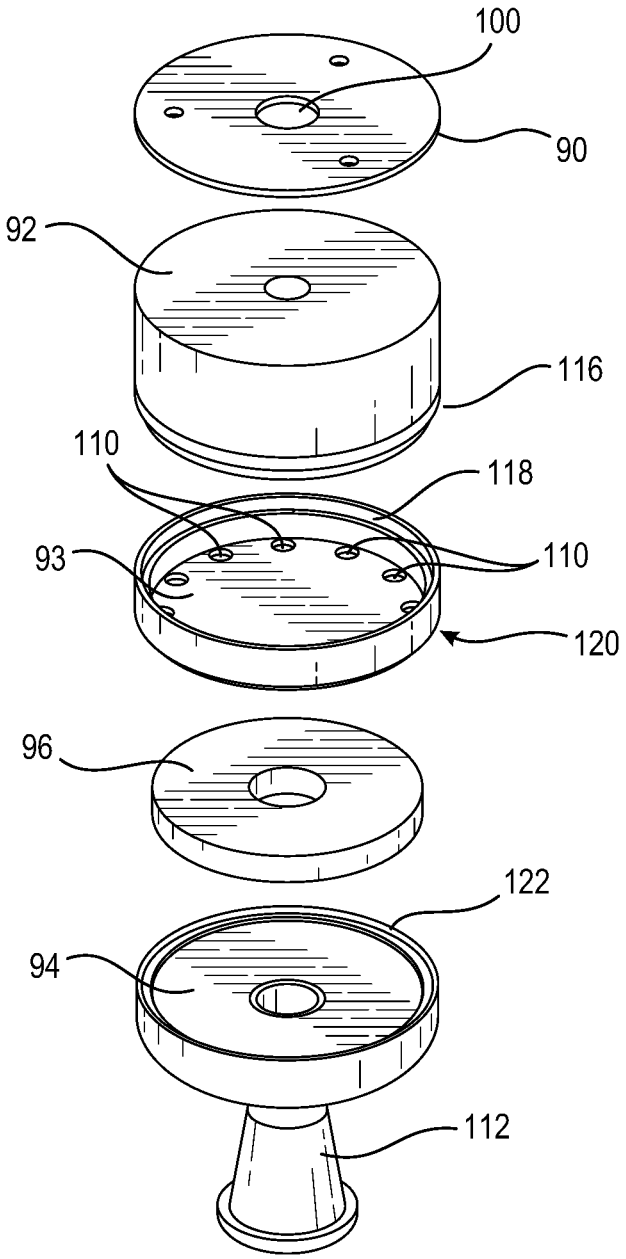
FIG. 12 is an exploded, perspective view of a further preferred form of the hookah sub-assembly.
Figure 13:
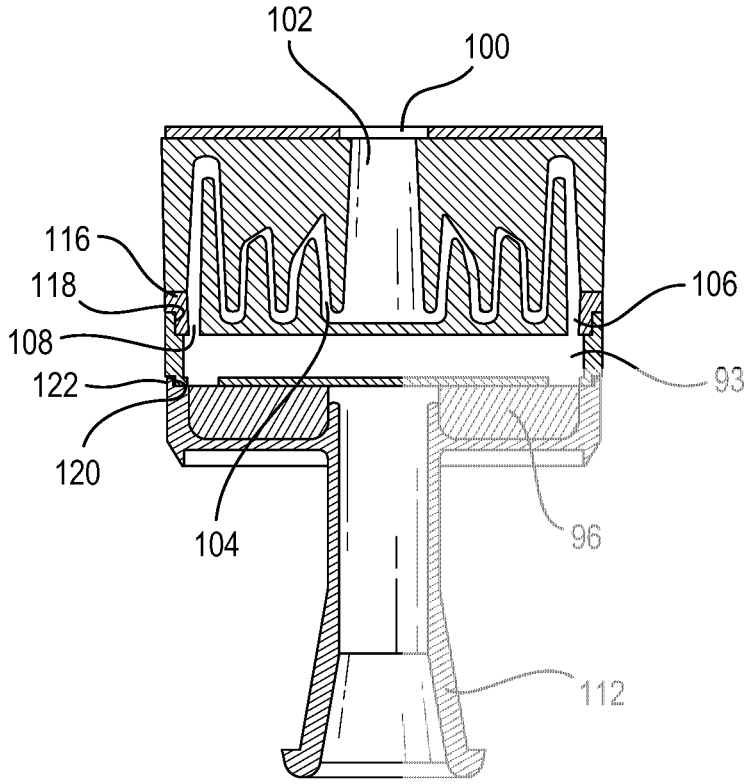
FIG. 13 is a cross-sectional view of the hookah sub-assembly of FIG. 12.
Figure 14:
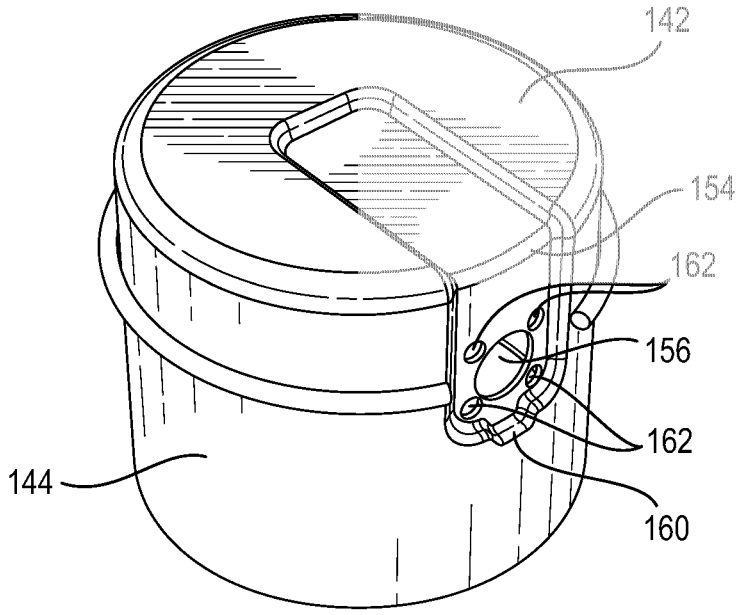
FIG. 14 is a perspective view of an alternative outer shell or heat shield for a hookah sub-assembly.
Figure 15:
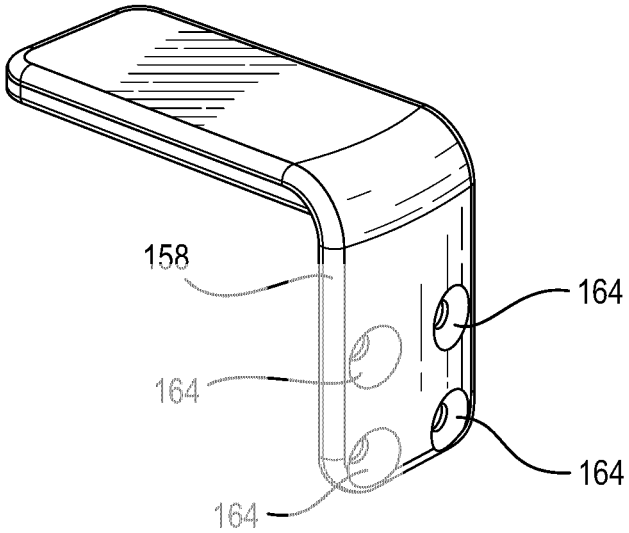
FIG. 15 is a perspective view of a sealing and source identifying tab configured to be detachably connected to the heat shield or outer shell depicted in FIG. 14.
Figure 16:
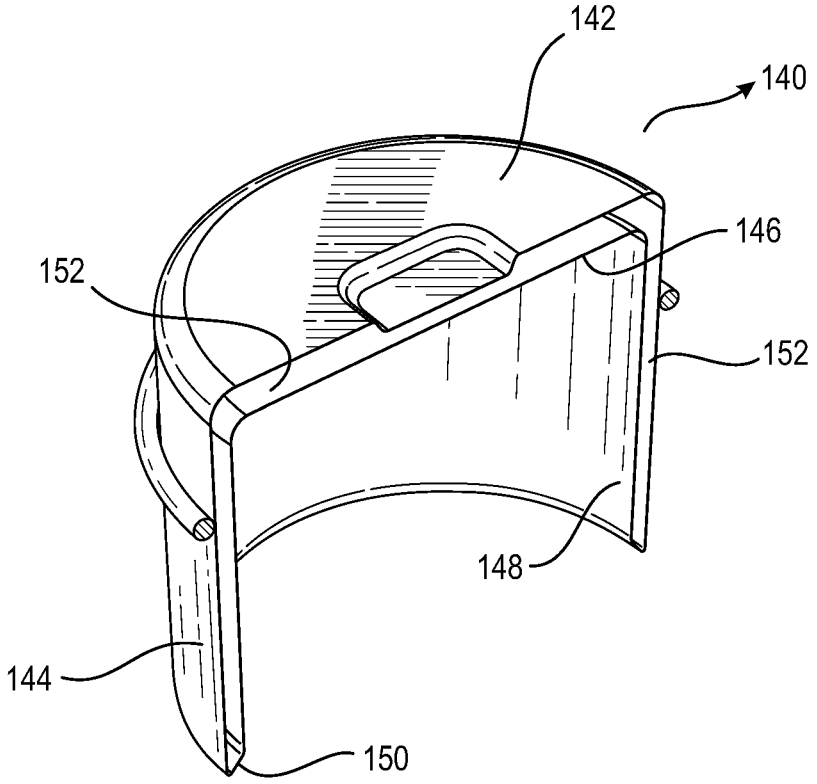
FIG. 16 is a cross-sectional perspective view of a portion of the outer shell or heat shield depicted.
Figure 17:
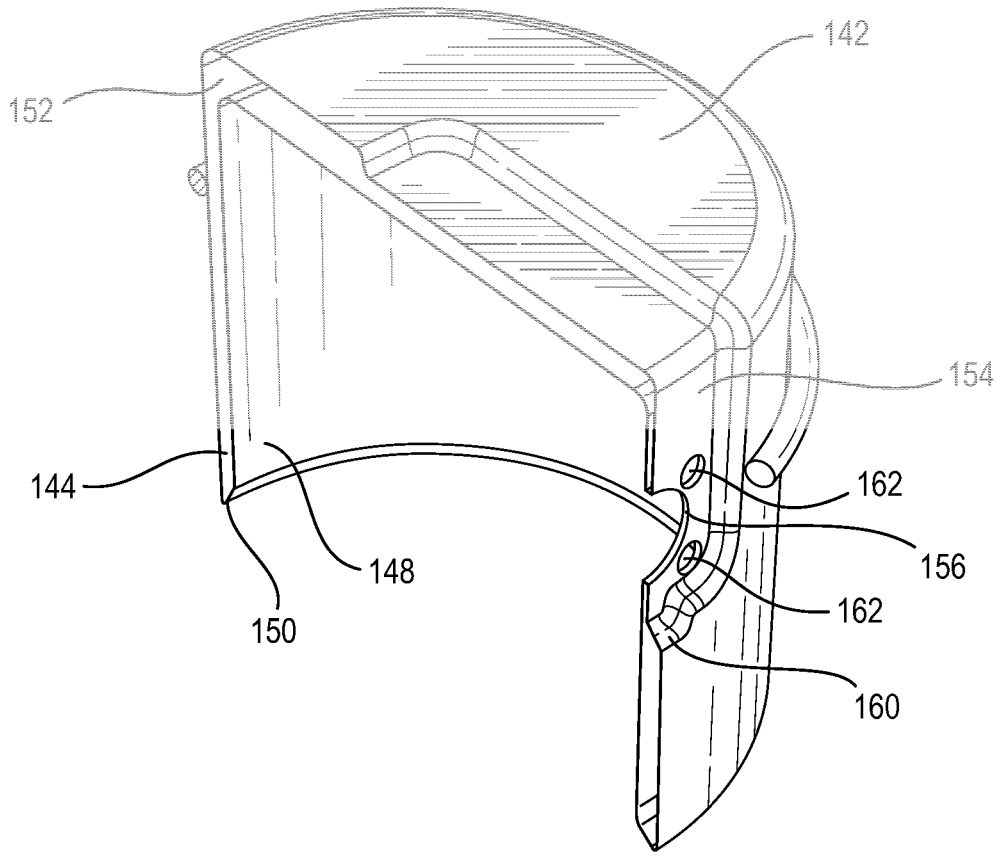
FIG. 17 is a cross-sectional perspective view of a portion of the outer shell or heat shield depicted taken from a different point than FIG. 16.

FIGS. 11 to 13 depict another alternative form of a hookah sub-assembly for a charcoal-less hookah. Hookah sub-assembly R of this embodiment is an electric hookah sub-assembly. FIG. 11 is a schematic of this embodiment. Hookah sub-assembly R includes a cylindrical or circular plate heating element 90 mounted or stacked on heat exchanger 92. Insulator 93 separates heating element 90 and heat exchanger 92 from tobacco bowl or housing 94 storing the substance to be smoked 96. Arrow S schematically shows how the heating heats the heat exchanger. Arrow T schematically represents the travel of ambient air through the heating element 90 and heat exchanger 92 into bowl 94. Arrow U schematically represents the travel of smoke downwardly through a central conduit of bowl 94. Arrow V schematically shows travel through the annular insulating air chamber of insulator 93.

Referring to FIGS. 12 and 13, heating element 90 preferably includes a central opening 100 extending therethrough which communicates with central opening 102 of heat exchanger 92. A lower portion of central opening 102 communicates with undulating airflow path 104 having a plurality of peaks and valleys. Referring to FIG. 13, lower outer ends 106 and 108 of airflow path 104 communicate with insulator 93. Insulator 93 includes a plurality of openings 110 (see FIG. 12) that communicate with bowl 94 and the substance to be smoked stored therein. Bowl 94 includes a central conduit 112 that allows smoke to travel downwardly during an inhalation stage. Conduit 112 can be directly connected to a tank housing a filtering liquid or one or more intermediate members can be used to connect conduit 112 to the tank housing a filtering liquid.

Referring to FIGS. 12 and 13, lower annular portion 116 of heat exchanger may be stepped inwardly to seat in a complimentary shaped stepped annular upper portion 118 of insulator 93. Lower annular portion 120 of insulator 93 may be stepped inwardly to seat in a complimentary shaped stepped annular upper portion 122 of insulator bowl 94. However, these elements can be stacked or connected in numerous other manners.

Referring to FIGS. 14 to 17, an alternative form of outer shell or heat shield to that of cover, shell or heat shield 10 will now be described. Cover, shell or heat shield 140 replaces the simple heat shield 10 with a vacuum insulated cavity design. Shield 140 should make it possible to touch the shield 140 without burning even after prolonged use. Shield 140 is preferably cylindrical with an outer horizontally extending wall 142, an outer vertically extending cylindrical wall 144, an inner horizontally extending wall 146, an inner vertically extending cylindrical wall 148 and a wall 150 extending between and connecting a lowermost end of wall 144 and a lowermost end of wall 148. A vacuum insulated cavity 152 is defined by walls 142, 144, 146, 148 and 150.

A recess or notch 154 is preferably formed in a portion of wall 142 and an adjacent portion of wall 144. An enlarged opening 156 is sufficiently sized to receive a portion of the electrical cord connecting the one or more heating elements to a power source. A sealing tab 158 seats in the notch or recess 154 with a lowermost portion of tab 158 being disposed above a portion 160 of notch or recess 154 that receives a corresponding portion of the electrical wire or cord. One or more openings 162 may be provided around opening 156 and one or more corresponding openings 164 may be provided in tab 158 to receive a fastener to attach sealing tab 158 to shell 140 to seal cavity 152.

While this invention has been described as having a preferred design, it is understood that the preferred design can be further modified or adapted following in general the principles of the invention and including but not limited to such departures from the present invention as come within the known or customary practice in the art to which the invention pertains. The claims are not limited to the preferred embodiment and have been written to preclude such a narrow construction using the principles of claim differentiation.

I claim:

1. A hookah sub-assembly, comprising:

(a) a charcoal-less heating element, a heat exchanger and a tobacco housing for housing tobacco or other substance to be smoked disposed below the heat exchanger and the charcoal-less heating element, wherein the tobacco or other substance to be smoked evaporates at a first temperature;

(b) said charcoal-less heating element being configured to heat ambient temperature air to a second temperature which is higher than said first temperature; and (c) an insulating section being configured to insulate the tobacco or other substance to be smoked so that a temperature the tobacco or other substance to be smoked is exposed to is less than the first temperature when the hookah sub-assembly is operating but not being used to smoke tobacco or other substance to be smoked and a temperature the tobacco or other substance to be smoked is exposed to is greater than or equal to the first temperature when the hookah sub-assembly is being used to smoke tobacco or other substance to be smoked without altering an operating temperature of the heating element, wherein the insulating section includes an air chamber formed between a lowermost portion of the heat exchanger and an uppermost portion of the tobacco housing for housing the tobacco or other substance to be smoked.

2. The hookah sub-assembly of claim 1, wherein:

(a) the first temperature is at least 50 degrees Celsius less than the second temperature.

3. The hookah sub-assembly of claim 1, wherein:

(a) the charcoal-less heating element is an electronic heating element configured to be operably connected to one of one or batteries or an electrical outlet.

4. The hookah sub-assembly of claim 3, wherein:

(a) the electronic heating element is a cylindrical plate positioned above a lower most portion of said heat exchanger;

(b) said heat exchanger is a cylindrical portion having a height at least twice a height of the cylindrical plate, said heat exchanger has a stepped lower portion; and, (c) said insulating section is a cylindrical portion having a stepped upper portion for receiving said stepped lower portion of said heat exchanger to support said heat exchanger, said insulating section having a plurality of openings formed in a bottom surface of said insulating section to allow air to pass from an insulating air chamber of said insulating section to the tobacco or other substance to be smoked; and, (d) a tobacco bowl for housing the tobacco or other substance to be smoked, said tobacco bowl having a stepped upper portion to receive a stepped lower portion of said insulating section to support said insulating section.

5. A hookah, comprising:

(a) an electronic heating element, a heat exchanger, a tobacco housing for housing tobacco or other substance to be smoked, a liquid housing for housing a filtering liquid, said tobacco housing being disposed below the heat exchanger and the electronic heating element, wherein the tobacco or other substance to be smoked evaporates at a first temperature;

(b) said electronic heating element being configured to heat ambient temperature air to a second temperature which is higher than said first temperature, at least a portion of said electronic heating element being disposed above at least a portion of said heat exchanger; and (c) an insulating member disposed below the heat exchanger and configured to insulate the tobacco or other substance to be smoked so that the temperature the tobacco or other substance to be smoked is exposed to is less than the first temperature when the hookah is operating but is not being used to smoke tobacco or other substance to be smoked and a temperature the tobacco or other substance to be smoked is exposed to is greater than the first temperature when the hookah is being used to smoke tobacco or other substance to be smoked.

6. The hookah of claim 5, wherein:

(a) the second temperature is at least 50 degrees Celsius higher than the second temperature.

7. The hookah of claim 5, wherein:

(a) said insulating member is configured to form an insulating air chamber.

8. The hookah of claim 7, wherein:

(a) said insulating member includes a stepped upper portion for receiving a stepped lower portion of said heat exchanger to support said heat exchanger, said insulating member includes a stepped lower portion to engage a stepped upper portion of said tobacco bowl.

9. The hookah of claim 8, wherein:

(a) the electronic heating element, the heat exchanger, the insulating member and an upper portion of said tobacco housing are cylindrical and an outer diameter of each of the heating element, the heat exchanger, the insulating member and an upper portion of said tobacco housing is the same.

10. The hookah of claim 9, wherein:

(a) the electronic heating element includes at least one plate disposed between an uppermost portion of said heat exchanger and a lowermost portion of said heat exchanger.

11. The hookah of claim 5, wherein:

(a) the heat exchanger has a height greater than a height of said insulating member.

12. The hookah of claim 7, wherein:

(a) the heat exchanger includes an opening for receiving air and a non-linear air flow path connected to said opening and said air chamber of said insulating member.

13. The hookah of claim 12, wherein:

(a) the heat exchanger includes an upper portion having a first member and a second member nested in said second member to from a first non-linear flow path and a lower portion having a third member and a fourth member nested in said third member to form a second non-linear flow path, said first non-linear flow path is in communication with said opening to receive air flowing into said opening, said second non-linear flow path is in communication with said first non-linear flow path to receive air exiting said first non-linear flow path; and, (b) said heating element includes two plates disposed between said upper portion and said lower portion of said heat exchanger.

14. The hookah of claim 13, wherein:

(a) the first non-linear air flow path and the second non-linear flow path are each an undulating path which includes a plurality of peaks and a plurality of valleys.

15. A hookah sub-assembly, comprising:

(a) a charcoal-less heating element, a heat exchanger and tobacco housing for housing tobacco or other substance to be smoked disposed below the heat exchanger and the charcoal-less heating element, wherein the tobacco or other substance to be smoked evaporates at a first temperature;

(b) said charcoal-less heating element being configured to heat ambient temperature air to a second temperature which is higher than said first temperature; and (c) an insulating section insulating the tobacco or other substance to be smoked so that a temperature the tobacco or other substance to be smoked is exposed to is less than the first temperature when the hookah sub-assembly is operating but not being used to smoke tobacco or other substance to be smoked and a temperature the tobacco or other substance to be smoked is exposed to is greater than or equal to the first temperature when the hookah sub-assembly is being used to smoke tobacco or other substance to be smoked; and (d) said hookah sub-assembly further comprising at least one of the following:

(i) said insulating member having a stepped upper portion for receiving a stepped lower portion of said heat exchanger to support said heat exchanger;

(ii) said insulating member having a stepped lower portion to engage a stepped upper portion of said tobacco housing;

(iii) the electronic heating element, the heat exchanger, the insulating member and an upper portion of said tobacco housing are cylindrical and an outer diameter of each of the heating element, the heat exchanger, the insulating member and an upper portion of said tobacco housing is the same;

(iv) the heat exchanger includes an upper portion having a first member and a second member nested in said first member to from a first non-linear flow path and a lower portion having a third member and a fourth member nested in said third member to form a second non-linear flow path, said first non-linear flow path is in communication with an opening to receive air flowing into said opening, said second non-linear flow path is in communication with said first non-linear flow path to receive air exiting said first non-linear flow path;

(v) said heating element includes two plates disposed between an upper portion of said heat exchanger and a lower portion of said heat exchanger; and, (vi) said heat exchanger having an upper portion including a first non-linear air flow path and a lower portion including a second non-linear flow path, said first non-linear flow path and said second non-linear air flow path each being an undulating path having a plurality of peaks and a plurality of valleys.

16. The hookah sub-assembly of claim 15, wherein:

(a) said insulating member has a stepped upper portion for receiving a stepped lower portion of said heat exchanger to support said heat exchanger; and (b) said insulating member has a stepped lower portion to engage a stepped upper portion of said tobacco housing.

17. The hookah sub-assembly of claim 15, wherein:

(a) said heat exchanger has an upper portion including a first non-linear air flow path and a lower portion including a second non-linear flow path, said first non-linear flow path and said second non-linear air flow path each being an undulating path having a plurality of peaks and a plurality of valleys.

18. The hookah sub-assembly of claim 15, wherein:

(a) the heat exchanger includes an upper portion having a first member and a second member nested in said first member to from a first non-linear flow path and a lower portion having a third member and a fourth member nested in said third member to form a second non-linear flow path, said first non-linear flow path is in communication with an opening to receive air flowing into said opening, said second non-linear flow path is in communication with said first non-linear flow path to receive air exiting said first non-linear flow path.

19. A hookah sub-assembly, comprising:

(a) a charcoal-less heating element, a heat exchanger and tobacco housing for housing tobacco or other substance to be smoked disposed below the heat exchanger and the charcoal-less heating element, wherein the tobacco or other substance to be smoked evaporates at a first temperature, said heat exchanger having at least one non-linear airflow path having a plurality of peaks and a plurality of valleys;

(b) said charcoal-less heating element being configured to heat ambient temperature air to a second temperature which is higher than said first temperature; and (c) an insulating section insulating the tobacco or other substance to be smoked so that a temperature the tobacco or other substance to be smoked is exposed to is less than the first temperature when the hookah sub-assembly is operating but not being used to smoke tobacco or other substance to be smoked and a temperature the tobacco or other substance to be smoked is exposed to is greater than or equal to the first temperature when the hookah sub-assembly is being used to smoke tobacco or other substance to be smoked.

20. The hookah sub-assembly of claim 19, wherein:

(a) said heat exchanger is formed from a the first portion and a second portion, the first portion and the section portion are substantially identical in configuration so that the first portion can form an upper portion of the heat exchanger when oriented in a first manner and the first portion can form a lower portion of the heat exchanger when oriented in a second manner and the second portion can form an upper portion of the heat exchanger when oriented in a first manner and the second portion can form a lower portion of the heat exchanger when oriented in a second manner.

21. The hookah sub-assembly of claim 19, wherein:

(a) each of said first portion and second portion of said heat exchanger have a non-linear airflow path formed by a first section nested in a second section.

22. The hookah sub-assembly of claim 19, wherein:

(a) said insulating section includes a member having a bottom wall and an annular vertical wall connected to said bottom wall to form a hollow cavity having a width equal to an inner diameter of the annular vertical wall, said bottom wall of said insulating section is mounted on an upper portion of said tobacco housing.

* * * * *